United States Patent [19]

Fujiyoshi et al.

[11] Patent Number: 4,873,949

[45] Date of Patent: Oct. 17, 1989

[54] METHOD OF AND APPARATUS FOR CONTROLLING VALVE OPERATION IN AN INTERNAL COMBUSTION ENGINE

[75] Inventors: Yoshihiro Fujiyoshi, Kanagawa; Takatoshi Aoki, Tokyo; Yasuhiro Urata, Saitama, all of Japan

[73] Assignee: Honda Giken Kogyo Kabushiki Kaisha, Tokyo, Japan

[21] Appl. No.: 273,882

[22] Filed: Nov. 18, 1988

[30] Foreign Application Priority Data

Nov. 19, 1987 [JP] Japan ..... 62-292617

[51] Int. Cl.[4] ..... F01L 9/02; F01L 1/02

[52] U.S. Cl. ..... 123/90.12; 123/90.16; 123/90.31

[58] Field of Search ..... 123/90.12, 90.13, 90.17, 123/90.31, 90.15, 90.16

[56] References Cited

U.S. PATENT DOCUMENTS

| | | | |
|---|---|---|---|
| 4,231,330 | 11/1980 | Garcea | 123/90.15 |
| 4,421,074 | 12/1983 | Garcea et al. | 123/90.15 |
| 4,452,186 | 6/1984 | List et al. | 123/90.16 |
| 4,466,390 | 8/1984 | Babitzka et al. | 123/90.16 |
| 4,535,731 | 8/1985 | Banfi | 123/90.17 |
| 4,627,825 | 12/1986 | Bruss et al. | 123/90.17 |
| 4,671,221 | 6/1987 | Geringer et al. | 123/90.12 |
| 4,674,451 | 6/1987 | Rembold et al. | 123/90.12 |
| 4,765,288 | 8/1988 | Linder et al. | 123/90.16 |
| 4,787,345 | 11/1988 | Thoma | 123/90.17 |
| 4,811,698 | 3/1989 | Akasaka et al. | 123/90.17 |

*Primary Examiner*—Charles J. Myhre
*Assistant Examiner*—Weilnn Lo
*Attorney, Agent, or Firm*—Lyon & Lyon

[57] ABSTRACT

A method and apparatus for controlling valve operation in an internal combustion engine having a crankshaft during with a cam for opening and closing an intake or exhaust valve which is spring-biased in a closing direction. The method comprises the steps of varying the angular phase of the crankshaft and the camshaft to control the timing of the opening of the valve and releasing the force applied by the cam to open the valve while it is being opened to control the timing of the closing of the intake or exhaust valve. The apparatus includes a phase control mechanism disposed between the crankshaft and the camshaft and a lift control mechanism disposed between the cam and the intake or exhaust valve. Both mechanisms are hydraulically operated and controlled in response to engine operating conditions.

13 Claims, 4 Drawing Sheets

METHOD OF AND APPARATUS FOR CONTROLLING VALVE OPERATION IN AN INTERNAL COMBUSTION ENGINE

The present invention relates to a method of and an apparatus for controlling valve operation in an internal combustion engine in which a camshaft has a cam for opening and closing an intake or exhaust valve which is spring-biased in a closing direction.

Japanese Laid-Open Patent Publication No. 61-145310 discloses an arrangement for controlling the timing of valve opening and closing and the amount of lift of an intake or exhaust valve. In that conventional arrangement, the back of a rocker arm is held at a fulcrum against a lever swingable along the back of the rocker arm and the position of the fulcrum on the rocker arm is changed by swinging the lever to variably control the lift characteristics of the intake or exhaust valve. The angular relationship or phase between the camshaft and the crankshaft is varied by a phase control means to control the timing of opening the valve. The phase control means can only control the phase to advance or retard the valve opening timing by a fixed value. In order to control the lift characteristics, it is necessary to shape the back of the rocker arm into a curved configuration, but it is difficult to form a curved surface corresponding to the amount of lift of the valve.

It is an object of the present invention to provide a method of and an apparatus for controlling valve operation in an internal combustion engine to continuously control the timing of opening an intake or exhaust valve and to easily control the lift characteristics of the valve.

According to the present invention, a method of controlling valve operation comprises the steps of varying the angular phase of the crankshaft and the camshaft dependent on operating conditions of the engine to control the timing of the opening of an intake or exhaust valve and then releasing the force applied by the cam to open the intake or exhaust valve while the intake or exhaust valve is being opened to control the timing of the closing of the intake or exhaust valve.

Further according to the present invention, an apparatus for controlling valve operation includes a phase control means disposed between the crankshaft and the camshaft, and a lift control means disposed between the cam and the intake or exhaust valve. The phase control means may include a rotatable shaft coupled to the camshaft, a timing wheel drivable by the crankshaft and disposed coaxially with the rotatable shaft for angular movement relative there&:o, a piston having one axial end facing into a hydraulic pressure chamber and normally spring-biased in one axial direction, the piston being coaxial with the rotatable shaft and the timing wheel, a coupling mechanism for operatively coupling the piston, the timing wheel, and the rotatable shaft to vary the angular phase of the timing wheel and the rotatable shaft dependent on axial movement of the piston, and a servovalve for cutting off the communication between the hydraulic pressure chamber and a hydraulic pressure supply passage or a hydraulic pressure release passage, in response to axial movement of the piston according to the amount of operation of an actuating member. The lift control means comprises a cam piston having one end operatively coupled to the cam, a working oil chamber in which the other end of the cam piston is disposed and which is held in communication with a hydraulic pressure source, a valve piston operatively coupled to the intake or exhaust valve for opening the intake or exhaust valve under hydraulic pressure from the working oil chamber, and a hydraulic pressure release valve connected to the working oil chamber for relieving the hydraulic pressure from the working oil chamber while the intake or exhaust valve is being opened.

With the method of the present invention, since the angular phase of the crankshaft and the camshaft is controlled as desired, the timing of opening the intake or exhaust valve can continuously be controlled. Furthermore, since the force applied by the cam to open the valve is being opened, the timing of closing the valve or the amount of lift thereof can easily be selected as desired. The control of the valve opening timing and the control of the valve closing timing can be combined for continuously and easily controlling the valve opening timing, the valve closing timing, and the amount of lift of the valve.

With the apparatus of the present invention, the phase control means can continuously control the angular phase as desired between the crankshaft and the camshaft by moving the piston to a position dependent on the amount of operation of the actuating member, and the lift control means can easily select the amount of lift of the intake or exhaust valve as desired by opening the hydraulic pressure release valve while the intake or exhaust is being opened.

The invention will be described in connection with a preferred embodiment shown in the drawings, wherein.

Figure 1:
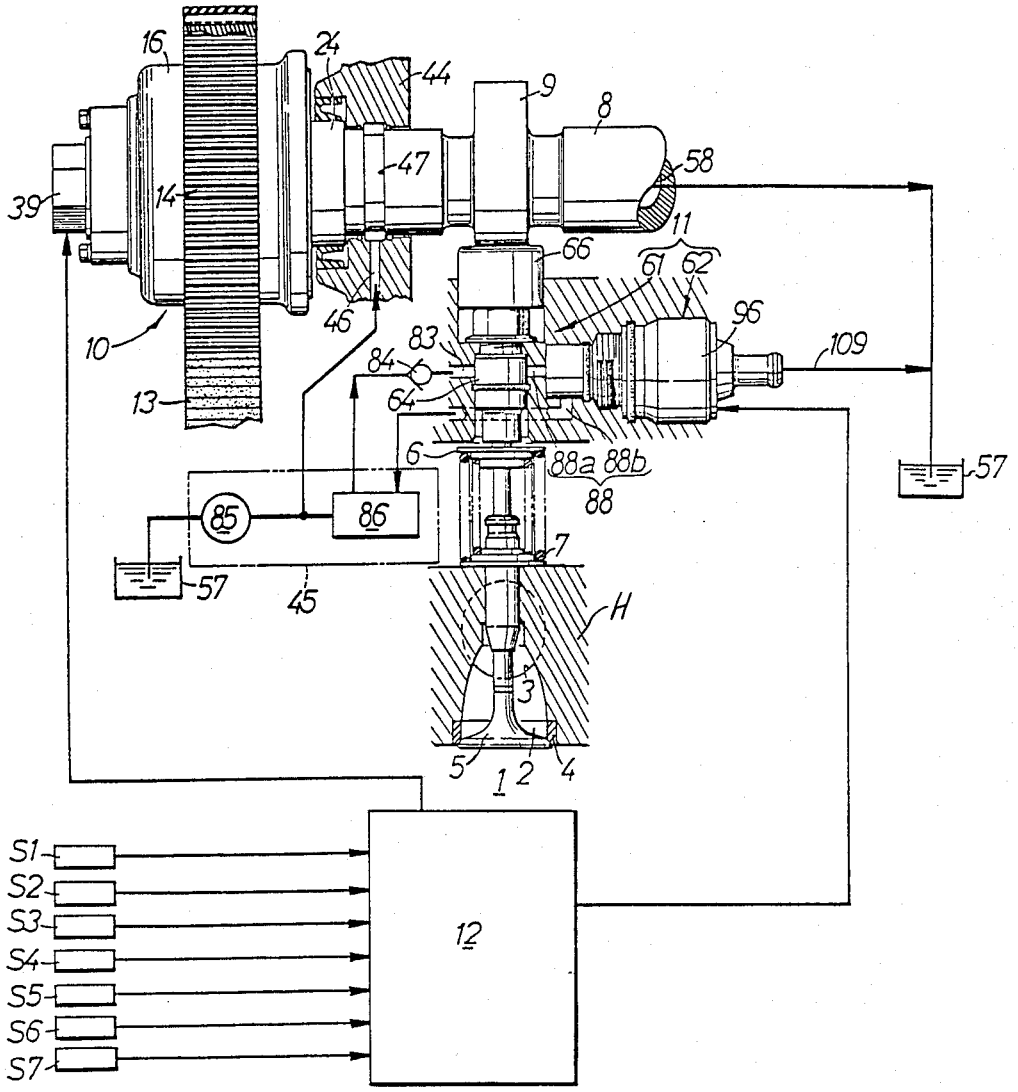
FIG. 1 is a vertical sectional view of the valve operating mechanism of the present invention.

The invention will be described with the reference to the operation of an intake valve but it is to be understood and will appear to those skilled in the art that the invention is equally applicable to an exhaust valve. As shown in FIG. 1, an internal combustion engine includes a cylinder head H having an overhead type valve mechanism with an intake valve port 2 opening into the upper end of a combustion chamber 1 defined between the cylinder head H and a cylinder block (not shown). The intake valve port 2 communicates with an intake port 3. An intake valve 5 which can be seated on a ring-shaped valve seat 4 fixedly disposed in the intake valve port 2 is vertically supported and guided by the cylinder head H for opening and closing the intake valve port 2. The intake valve 5 is normally biased upwardly, i.e., in the closing direction under the forces of a valve spring 7 disposed under compression between a flange 6 mounted on the upper end of the intake valve 5 and the cylinder head H.

A camshaft 8 having a cam 9 is rotatably disposed above the cylinder head H. The camshaft 8 is operatively coupled to a crankshaft (not shown) through a phase control means 10. A lift control means 11 is disposed between the cam 9 and the intake valve 5. Operation of the phase control means 10 and the lift control means 11 is controlled by a control unit 12 that responds to the operating conditions of the engine. To the control unit 12 there are connected sensors S1 through S7 which detect parameters regarding the operating conditions of the engine, e.g., the rotational speed of the engine, the temperature of the working oil, the crank angle, the amount of intake air, the temperature of the intake air, the concentration of oxygen in exhaust gases, the amount of depression of the accelerator pedal, and the like.

Figure 2:
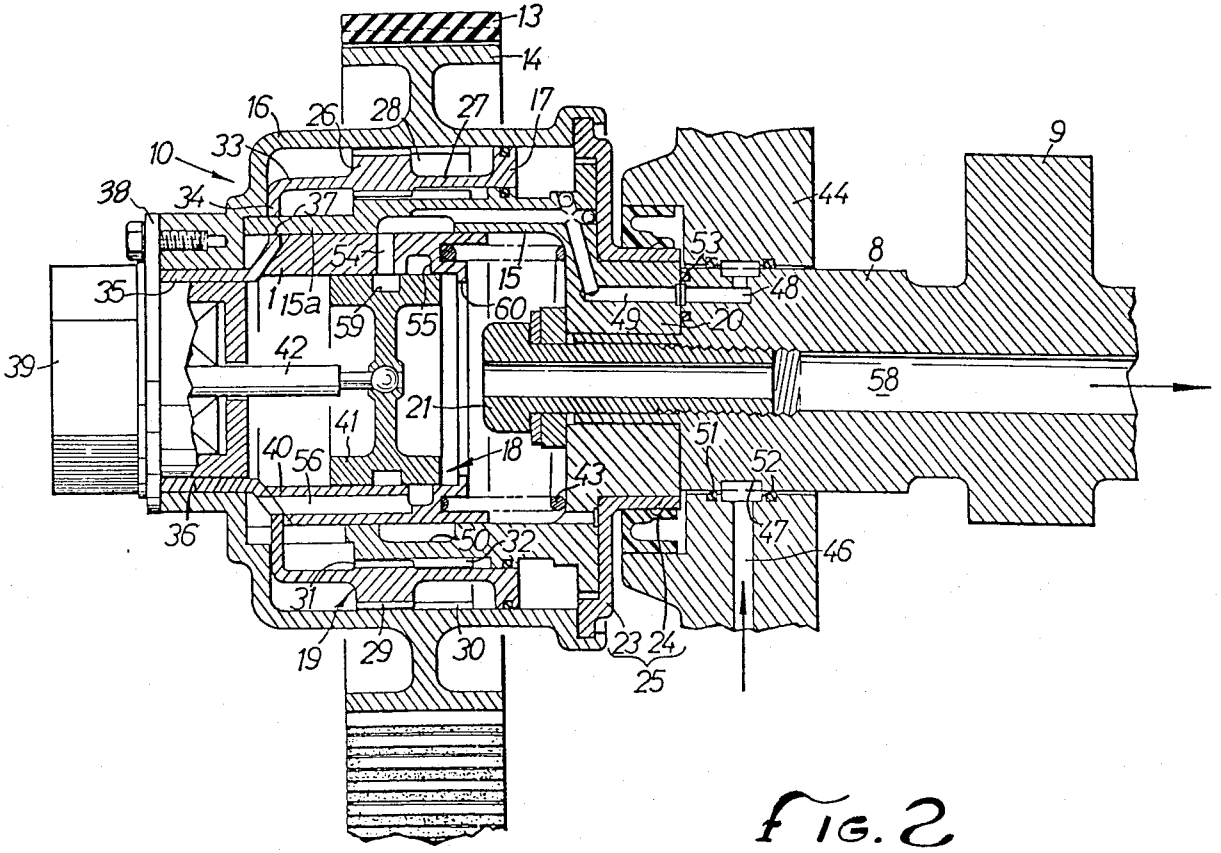
FIG. 2 is an enlarged vertical sectional view of the phase control means of the invention.

As shown in FIG. 2, the phase control means 10 comprises a pulley or timing wheel 14 with a timing belt 13 trained around it for transmitting rotative power from the crankshaft, a rotatable shaft 15 coaxially coupled to the camshaft 8, a housing 16 integral with the pulley 14 and surrounding the rotatable shaft 15 in coaxial relationship, a piston 17 slidably fitted between the rotatable shaft 15 and the housing 16, a servovalve 18 for controlling axial movement of the piston 17, and a coupling mechanism 19 for operatively coupling the piston 17, the housing 16, and the rotatable shaft 15 in order to angularly displace the housing 16 and the rotatable shaft 15 in mutually opposite directions according to axial movement of the piston 17.

The rotatable shaft 15 is in the form of a hollow bottomed cylinder with a shaft portion 20 on its closed end. The shaft portion 20 is fixed coaxially to an end of the camshaft 8 by means of a bolt 21 extending through the closed end of the shaft 15 and threaded into the camshaft 8. The housing 16 is also in the form of a hollow bottomed cylinder which is open toward the camshaft 8. The pulley 14 is integrally disposed on an outer peripheral surface of the housing 16. A cap 25 has its outer peripheral edge fitted in the open end of the housing 16. The cap 25 comprises an end plate 23 slidably held against the outer surface of the closed end of the rotatable shaft 15 and a cylindrical portion 24 slidably held against the outer surface of the shaft portion 20. The rotatable shaft 15 has its distal end slidably held against the inner surface of the closed end of the housing 16. Therefore, the housing 16 and the pulley 14 are prevented from axially moving with respect to the rotatable shaft 15, i.e., the camshaft 8, but are allowed to rotate about their axis.

The piston 17 is of a ring shape having an outer surface slidably held against the inner surface of the housing 16 and an inner surface slidably held against the outer surface of the rotatable shaft 15. A ring-shaped meshing member 26 is disposed in axially spaced relation to the piston 17, and inner edges of the piston 17 and the meshing member 26 are joined to each other by a connecting sleeve 27 surrounding the rotatable shaft 15 in coaxial relationship. The piston 17, the meshing member 26, the connecting sleeve 27, and the housing 16 jointly define therebetween a hydraulic pressure chamber 28 for exerting a hydraulic pressure for urging the piston 17 in one axial direction, i.e., to the right in FIG. 2.

The coupling mechanism 19 comprises helical outer teeth 29 on the outer surface of the meshing member 26, helical inner teeth 30 on the inner surface of the housing 16 in mesh with the helical outer teeth 29, helical inner teeth 31 on the inner surface of the meshing member 26, and helical outer teeth 32 on the outer surface of the rotatable shaft 15 in mesh with the helical inner teeth 31. In response to axial movement of the piston 17, the coupling mechanism 19 causes relative rotation the housing 16, i.e., the pulley 14, and the rotatable shaft 15, i.e., the camshaft 8 about their axis. This changes the angular relationship between the pulley 14 and camshaft 8.

A first cylindrical portion 33 is integrally joined to the inner edge of the meshing member 26 and extends away from the connecting sleeve 27. The first cylindrical portion 33 has on its distal end a flange 34 extending radially inwardly and engageable with the closed end of the housing 16. A second cylindrical portion 35 is integrally joined to an inner edge of the flange 34 and slidably fitted in a through hole 36 defined centrally in the closed end of the housing 16. The movement of the piston 17 in the other axial direction (to the left in FIG. 2) is limited by engagement of the flange 34 with the housing 16. The flange 34 has a plurality of slots 37 curved in the circumferential direction. A plurality of projections or fingers **15*a* integral with the distal end of the rotatable shaft 15 are inserted respectively through the slots 37 for engagement with the closed end of the housing 16. The piston 17 is angularly movable relatively to the rotatable shaft 15 in an angular range defined between the opposite ends of each of the slots 37 which are engageable by the corresponding finger 15*a*. A support plate 38 is fixed to the housing 16 in closing relation to the throughhole 36. A servomotor 39 is fixedly mounted on the support plate 38 coaxially with the rotatable shaft 15. Operation of the servomotor 39 is controlled by the control unit 12**.

The servovalve 18 comprises a cylindrical sleeve 40 slidably fitted in the rotatable shaft 15 and a cylindrical spool 41 slidably fitted in the sleeve 40. A driver shaft 42 serves as an actuating member coupled to the servomotor 39 for varying the axial position of the spool 41 and is connected to the spool 41. A return spring 43 is disposed between one end of the spool 40 and the closed end of the rotatable shaft 15 for normally urging the sleeve 40 in a direction to cause the other end of the sleeve 40 to abut against the flange 34. Therefore, the piston 17 is spring-loaded in the other axial direction against the hydraulic pressure in the hydraulic pressure chamber 28.

A holder 44 in which the camshaft 8 is rotatably supported has a first hydraulic pressure supply passage 46 defined therein in communication with a hydraulic pressure source 45 (see FIG. 1). The camshaft 9 has an annular groove 47 defined in an outer peripheral surface thereof and communicating with the first hydraulic pressure supply passage 46, and also has a second hydraulic pressure supply passage 48 defined therein and communicating with the annular groove 47. The rotatable shaft 15 has a third hydraulic pressure supply passage 49 defined therein and held in communication with the second hydraulic pressure supply passage 48 at ell times. The rotatable shaft 15 also has an annular groove 50 defined in an inner peripheral surface thereof and communicating with the third hydraulic pressure supply passage 49. A pair of annular seal members 51, 52 are interposed between the camshaft 8 and the holder 44 in sandwiching relation to the annular groove 47. Another annular seal member 53 is interposed between the camshaft 8 and the rotatable shaft 15 for keeping the second and third hydraulic pressure supply passages 48, 49 in communication with each other.

The sleeve 40 has an oil hole 54 defined radially therethrough which is held in communication with the annular groove 50 at all times irrespective of the axial position of the sleeve 40 with respect to the rotatable shaft 15. The sleeve 40 also has an annular groove 55 defined in an inner peripheral surface thereof at a position adjacent to the open end of the oil hole 54 on one axial side thereof (on the righthand side thereof as shown in FIG. 2). The sleeve 40 and the flange 34 held against the sleeve 40 have an oil passage 56 defined therein through which the annular groove 55 communicates with the hydraulic pressure chamber 28. The bolt 21 and the camshaft 8 have a pressure release passage 58 defined therethrough and held in communication with an oil tank 57 (FIG. 1).

An annular groove 59 is defined in an outer peripheral surface of the spool 41 and has an axial width selected such that it can provide fluid communication between the oil hole 54 and the annular groove 55. The spool 41 is axially movable between three positions, i.e., a cutoff position in which only the oil hole 54 communicates with the annular groove 59, a supply position axially displaced in one axial direction from the cut off position, in which the oil hole 54 and the annular groove 55 communicate with each other through the annular groove 59, and a release position axially displaced in the other axial direction from the cutoff position, in which the annular groove 55 communicates with the hydraulic pressure release passage 58. The sleeve 40 has a stopper 60 extending radially inwardly from an axial end thereof for abutting against the spool 41 to limit relative axial movement of the sleeve 40 and the spool 41.

For varying the phase or angular relationship between the crankshaft and the camshaft 8 with the phase control means 10, the driver shaft 42 is axially moved to move the spool 41 in one axial direction from the cutoff position shown in FIG. 2. More specifically, the spool 41 is moved in one axial direction from the illustrated position relatively to the sleeve 40 into the supply position in which the oil hole 54 and the annular groove 55 communicate with each other through the annular groove 59. Oil pressure from the hydraulic pressure supply source 45 is then supplied into the hydraulic pressure chamber to move the piston 17 in one axial direction against the spring forces of the return spring 43. The axial movement of the piston 17 causes the housing 16, i.e., the pulley 14, and the rotatable shaft 15, i.e., the camshaft 8 to turn relatively to each other through the coupling mechanism 19, so that the timing of the opening of the intake valve 5 is advanced, for example. Since the sleeve 40 is also moved in one axial direction by the axial movement of the piston 17, the spool 41 is moved relative to the spool 40 in the other axial direction until the spool 41 and the sleeve 40 are axially relatively positioned in the cutoff position. The amount of movement of the piston 17 is therefore determined by the amount of axial movement of the spool 41, and so is the extent to which the timing of opening of the intake valve is advanced. The extent to which the valve opening timing is advanced can continuously be controlled dependent on the amount of movement of the spool 41.

When the driver shaft 42 is moved in the opposite axial direction to move the spool 41 relative to the sleeve 40 from the cutoff position, the spool 41 reaches the release position in which the annular groove 55 communicates with the hydraulic pressure release passage 58. The oil pressure in the hydraulic pressure chamber 28 is thus released. The piston 17 is then moved in the other axial direction under the resiliency of the return spring 43 for thereby causing the pulley 14 and the camshaft 8 to be turned relatively to each other in the opposite direction. The timing of the opening the intake valve 5 is now retarded. The sleeve 40 is moved with the piston 17 in the other axial direction, and the spool 41 is moved relative to the sleeve 40 in said one axial direction, bringing the spool 41 and the sleeve 40 into the cutoff position. Consequently, the extent to which the valve opening timing is retarded is determined dependent on the amount of axial movement of the spool 41 and hence can continuously be controlled dependent on the amount of movement of the spool 41.

Figure 3A:
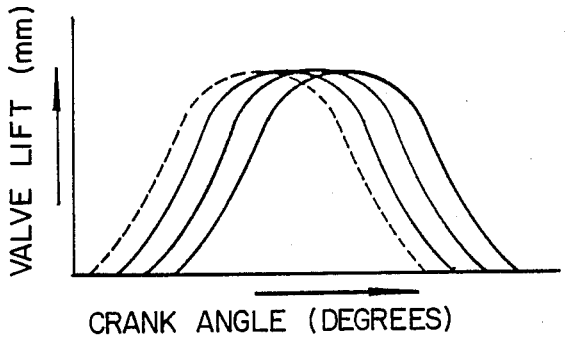
FIG. 3A is a graph showing the controlling characteristics of the phase control means.

By thus axially moving the spool 41 with the driver shaft 42, the piston 17 is moved with the movement of the spool 41. The timing of the opening of the intake valve 5 can continuously be advanced or retarded as shown in FIG. 3A.

Figure 4:
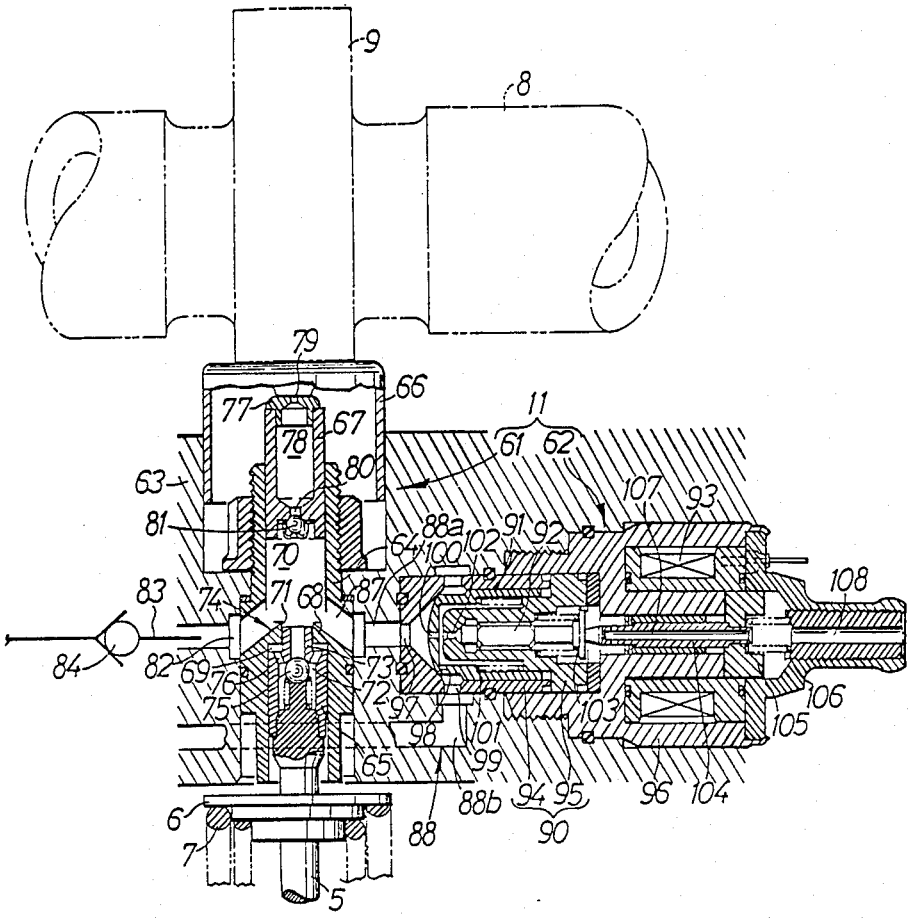
FIG. 4 is an enlarged vertical sectional view of the lift control means.

As illustrated in FIG. 4, the lift control means 11 has a hydraulic actuator mechanism 61 for opening and closing the intake valve 5 according to the cam profile of the cam 9, and a hydraulic release valve 62 for cutting off or releasing the operating force of the hydraulic actuator mechanism 61 to lower the intake valve 5 while the intake valve 5 is being opened.

The hydraulic actuator mechanism 61 is disposed in a support member 63 fixedly mounted on the cylinder head H. The hydraulic actuator mechanism 61 has a cylinder 64 disposed vertically above the intake valve 5 and fixedly fitted in the support member 63, a valve piston 65 held against the upper end of the intake valve 5 and slidably fitted in a lower portion of the cylinder 64, lifter 66 slidably held against the cam 9, and a cam piston 67 having an upper end abutting against the lifter 66 and slidably fitted in an upper portion of the cylinder 64.

The cylinder 64 has a partition wall 68 in an intermediate location, dividing the interior space of the cylinder 64 into upper and lower spaces. The valve piston 65 and the partition wall 68 define therebetween a damper chamber 69, and the cam piston 67 and the partition wall 68 define therebetween a working oil chamber 70. The partition wall 68 has a central communication hole 71 through which the damper chamber 69 and the working oil chamber 70 can communicate with each other.

The valve piston 65 has an oil chamber 72 defined therein, and includes a short cylindrical portion 73 disposed coaxially on the upper central end thereof and insertable into the communication hole 71. The short cylindrical portion 73 and the communication hole 71 jointly constitute a restriction 74. More specifically, the outside diameter of the short cylindrical portion 73 is selected such that there is left a gap having a dimension ranging from several tens to several hundreds $\mu$m between the outer surface of the cylindrical portion 73 and the inner surface of the communication hole 71. With the short cylindrical portion 73 inserted in the communication hole 71, a thin annular passage is defined between the outer surface of the cylindrical portion 73 and the inner surface of the communication hole 71 for restricting the rate of flow of working oil from the damper chamber 69 into the working oil chamber 70. The thin annular passage or restriction 74 is formed only when the short cylindrical portion 73 is inserted in the communication hole 71. The short cylindrical portion 73 has an axial length selected such that it is inserted into the communication hole 71 while the intake valve 5 is in the final process of being closed, i.e., the valve piston 65 is being lifted under the bias of the valve spring 7.

The oil chamber 72 in the valve piston 65 houses a one-way valve 75 which is openable to introduce working oil from the short cylindrical portion 73 into the oil chamber 72 when the hydraulic pressure in the short cylindrical portion 73 is higher than that in the oil chamber 72 by a certain value. The valve piston 65 has through holes 76 providing communication between the oil chamber 72 and the damper chamber 69. When the hydraulic pressure in the working oil chamber 70 is increased with the short cylindrical portion 73 inserted in the communication hole 71, the working oil from the working oil chamber 70 is introduced from the oil chamber 72 into the damper chamber 69.

When the short cylindrical portion 73 is positioned below the communication hole 71, i.e., the intake valve 5 is depressed and opened, and when the intake valve 5 is in the process of being lifted and closed from the fully open position under the bias of the valve spring 7, the restriction 74 does not restrict the oil flow. The restriction 74 restricts the oil flow from the time when the short cylindrical portion 73 is inserted into the communication hole 71 as the intake valve 5 is closed until the intake valve 5 is fully closed.

The cam piston 67 is of a bottomed cylindrical shape with its closed end directed downwardly. The cam piston 67 has an upper open end closed by a closure member 77 which is engageable with the lifter 66. The lifter 66 is also of a bottomed cylindrical shape with the closed end having an outer surface slidably held against the cam 9. The lifter 66 is slidably fitted in an upper portion of the support member 63.

Between the cam piston 67 and the closure member 77, there is defined a reservoir chamber 78 for storing working oil. The closure member 77 has a through hole 79 defined therethrough for guiding the working oil from the reservoir chamber 78 to mutually sliding surfaces of the lifter 66 and the closure member 77. The closed end of the cam piston 67 has an oil hole 80 which can communicate with the working oil chamber 70 and which is associated with a check valve 81 for allowing the working oil to flow only from the reservoir chamber 78 into the working oil chamber 70.

The cylinder 64 has an inlet hole 82 communicating with the working oil chamber 70. The support member 63 has an inlet oil passage 83 defined therein in communication with the inlet hole 82. The inlet oil passage 83 is connected to the hydraulic pressure supply source 45 through a check valve 84 which prevents the working oil from flowing from the working oil chamber 70. As shown in FIG. 1, the hydraulic pressure source 45 comprises a hydraulic pump 85 for pumping working oil from the oil tank 57 and a reservoir chamber 86 for storing the working oil discharged from the hydraulic pump 85. The inlet oil passage 83 is connected to the reservoir chamber 86 through the check valve 84. The first hydraulic pressure passage 46 of the phase control means 10 is supplied with hydraulic pressure from the hydraulic pump 85.

The cylinder 64 has an outlet hole 87 communicating with the working oil chamber 70. The outlet hole 87 is coupled to the reservoir chamber 86 through an outlet oil passage 88 in which the hydraulic pressure release valve 62 is disposed.

When the intake valve 5 is fully closed, the hydraulic pressure actuator mechanism 61 is in the position shown in FIG. 4. The lifter 66 is lowered from the illustrated position upon rotation of the camshaft 8. The lifter 66 as it is lowered displaces the cam piston 67 downwardly to reduce the volume of the working oil chamber 70. With the hydraulic pressure release valve 62 closed, the working oil in the working oil chamber 70 is introduced through the one-way valve 75 into the damper chamber 69. The valve piton 65 is now lowered to open the intake valve 5 against the resiliency of the valve spring 7.

When the lifter 66 discontinues its downward movement caused by the cam 9 and the intake valve 5 has been fully opened, the intake valve 5 is lifted in the closing direction by the spring force of the valve spring 7. While the intake valve 5 is being closed, the valve piston 65 is also lifted to force the working oil to flow from the damper chamber 69 through the communication hole 71 back into the working oil chamber 70. During the valve closing stroke of the intake valve 5, the short cylindrical portion 73 is inserted into the communication hole 71, whereupon the restriction 74 starts restricting the oil flow, thereby limiting the flow of the working oil from the damper chamber 69 into the working oil chamber 70. Therefore, the speed of the upward movement of the intake valve 5, i.e., the valve closing speed, is reduced while the intake valve 5 is still in the valve closing stroke to permit the intake valve 5 to be gradually seated on the valve seat 4. Shocks which would otherwise be caused when the valve 5 is seated too rapidly are lessened, and damage to the intake valve 5 and the valve seat 4 is minimized.

The hydraulic pressure release valve 62 is disposed between an upstream portion **88*a* of the outlet oil passage 88 which communicates with the working oil chamber 70 and a downstream portion 88*b* of the outlet oil passage 88 which communicates with the reservoir chamber 86, the hydraulic pressure release valve 62 being controlled by the control unit 12. The hydraulic pressure release unit 62 comprises a valve housing 90 fitted in the support member 63, a main valve 91 slidably fitted in the valve housing 90 for selectively allowing and cutting off communication between the upstream and downstream portions 88*a*, 88*b* of the outlet oil passage 88, a pilot valve 92 for operating the main valve 91 by controlling the balance of hydraulic pressures acting on the opposite surfaces of the main valve 91, and a solenoid 93 for actuating the pilot valve 92. Energization and deenergization of the solenoid 93 are controlled by the control unit 12**.

The valve housing 90 comprises a first bottomed cylindrical member 94 and a second bottomed cylindrical member 95 inserted in the first bottomed cylindrical member 94 and engageable with an open end thereof to close the same. The valve housing 90 is fitted in the support member 63 in a fluid-tight manner. A casing 96 with the solenoid 93 housed therein is threaded in the support member 63, and the valve housing 90 is sandwiched between the casing 96 and the support member 63.

The first bottomed cylindrical member 94 of the valve housing 90 has a main valve hole 97 defined in the distal end thereof and communicating with the upstream portion **88*a* of the outlet oil passage 88, and also has a tapered valve seat 98 on an inner surface of the distal end thereof in surrounding relation to the main valve hole 97. The first bottomed cylindrical member 94 further includes a hole 99 defined in a side wall thereof in communication with the downstream portion 88*b* of the outlet oil passage 88. The main valve 91 is in the form of a hollow bottomed cylinder with its closed end seatable on the valve seat 98. The main valve 91 is slidably fitted in the valve housing 90, and is normally urged in a direction to be seated on the valve seat 98 under the bias of a spring 101 disposed between the main valve 91 and the second bottomed cylindrical member 95. When the main valve 91 is seated on the valve seat 98, it cuts off communication between the main valve hole 97 and the hole 99, and when the main valve 91 is unseated from the valve seat 98, it allows communication between these holes 97, 99**.

An orifice 100 is defined in the distal end, i.e., closed end of the main valve 91. When the main valve 91 is seated on the valve seat 98, holding the holes 97, 99 out of communication with each other, the front surface of the main valve 91 is subjected to a force tending to open the main valve 91 under the hydraulic pressure supplied from the main valve hole 97, and the rear surface of the main valve 91 is subjected to a force tending to close the main valve 91 under the hydraulic pressure supplied through the orifice 100 and the resiliency of the spring 101. When the hydraulic pressure acting on the rear surface of the main valve 91 is reduced, the force tending to open the main valve 91 becomes smaller than the force tending to close the main valve 91, forcing the main valve 91 to be unseated off the valve seat 98 thereby allowing communication between the main valve hole 97 and the hole 99.

The second bottomed cylindrical member 95 has a pilot valve hole 102 defined in the distal end thereof for releasing the hydraulic pressure on the rear surface of the main valve 91. The pilot valve hole 102 can be opened and closed by the pilot valve 92 which is slidably fitted in the second bottomed cylindrical member 95. A spring 103 acts under compression between the second bottomed cylindrical member 95 and the pilot valve 92 for normally urging the pilot valve 92 in a valve opening direction. The rear end of the pilot valve 92 is engaged by the tip end of a driver rod 104 slidably fitted in the casing 96. The driver rod 104 has a rear end fixed to an armature 105 which can be retracted (to the right in FIG. 4) in response to energization of the solenoid 93. The armature 105 is normally urged in a forward direction (to the left in FIG. 4) under the bias of a spring 106 disposed between the armature 105 and the casing 96. When the solenoid 93 is energized, the armature 105 and the driver rod 104 are retracted to enable the spring 103 to open the pilot valve 92 and hence the pilot valve hole 102.

The driver rod 104 has a passage 107 defined axially therethrough which can communicate with the pilot valve hole 102 when the pilot valve 92 is opened. The passage 107 communicates with a passage 108 defined in the rear end of the casing 96 and is coupled to the oil tank 57 through a release pipe 109 (see FIG. 1).

The main valve 91 of the hydraulic pressure release valve 62 can be opened by energizing the solenoid 93 to open the pilot valve 92 to release the hydraulic pressure acting on the rear surface of the main valve 91. When the main valve 91 is opened, the hydraulic pressure in the working oil chamber 70 of the hydraulic pressure actuator mechanism 61 can be relieved into the reservoir chamber 86. When the hydraulic pressure release valve 62 is opened while the cam piston 67 of the hydraulic pressure actuator mechanism 61 is being lowered by the cam 9 to open the intake valve 5, the hydraulic pressure in the working oil chamber 70 and the damper chamber 69 is relieved into the reservoir chamber 86, thus eliminating the downward force which has been applied to the valve piston 65, whereupon the valve piston 65 and the intake valve 5 start ascending back under the bias of the valve spring 7 to start closing the intake valve 5. The intake valve 5 therefore begins to close before it is fully opened. By selecting the timing to open the hydraulic pressure release valve 62 as desired, the timing of the closing of the intake valve 5 can freely and easily be selected as shown in FIG. 3(*b*).

When the hydraulic pressure in the working oil chamber 70 is lowered, hydraulic pressure from the hydraulic pressure source 45 is supplied into the working oil chamber 70 through the check valve 84 to allow the intake valve 5 to be opened in a next cycle without failure.

Figure 3B:
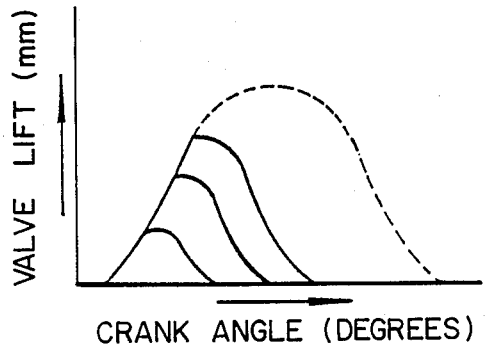
FIG. 3B is a graph showing the controlling characteristics of the lift control means.
Figure 3C:
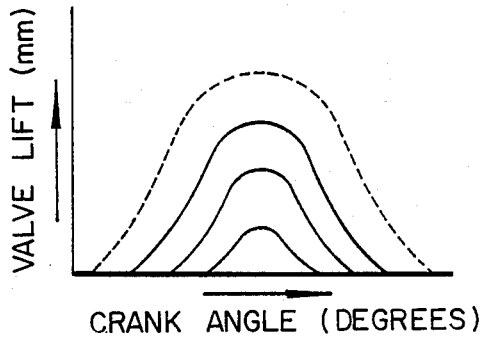
FIG. 3C is a graph showing the controlling characteristics combining phase and lift control.

As described above, the timing to open the intake valve 5 can continuously and easily be selected by the phase control means 10 as shown in FIG. 3A, and the timing to close the intake valve 5 or the amount of lift thereof can freely and easily be selected by the lift control means 11 a shown in FIG. 3B. Therefore, the timing to open the intake valve 5 and the timing to close the intake valve 5 or the amount of lift thereof can freely and easily be controlled as shown in FIG. 3C. The operation of the intake valve 5 can thus be controlled appropriately dependent on operating conditions of the engine. Since the amount of intake air and the timing of introducing intake air including the timing of fully closing the intake valve 5 can freely be controlled, it is possible to dispense with even the intake throttle valve of the engine, with the result that the internal combustion engine can operate with high efficiency because it is free of the problem of pumping loss which would otherwise be caused by the intake throttle valve.

While the control of the operation of an intake valve 5 has been described in the above embodiment, the present invention is also applicable to the control of the operation of an exhaust valve. The valve operation control of this invention may be used for all or only a portion of the valves of each cylinder and for all or only a portion of all the cylinders.

With the present invention, as described above, the method of controlling valve operation comprises the steps of varying the angular phase of the crankshaft and the camshaft dependent on operating conditions of the engine to control the timing of opening an intake or exhaust valve, and releasing the force applied by the cam to open the intake or exhaust valve while the intake or exhaust valve is being opened to control the amount of opening of and the timing of the closing of the intake or exhaust valve. It is therefore possible to continuously and easily vary the timing of opening and closing the intake or exhaust valves for accurate valve operation control dependent on the operating conditions of the engine.

The apparatus for controlling valve operation includes a phase control means disposed between the crankshaft and the camshaft and a lift control means disposed between the cam and the intake or exhaust valve. Consequently, by combining the phase control means and the lift control means, it is possible to freely control the timing of opening the intake or exhaust valves and the timing of closing the intake or exhaust valves.

What is claimed is:

1. A method of controlling valve operation in an internal combustion engine having a crankshaft for driving a camshaft with a cam for opening and closing an intake or exhaust valve which is spring-biased in a closing direction, said method comprising the steps of, varying the angular phase of the crankshaft and the camshaft dependent on operating conditions of the engine to control the timing of opening the intake or exhaust valve, and releasing a force applied by the cam to open the intake or exhaust valve while the intake or exhaust valve is being opened to control the timing of closing the intake or exhaust valve.

2. A method according to claim 1, wherein the step of releasing the force applied by the cam is dependent on operating conditions of the engine.

3. A method according to claim 1, wherein the varying of the angular phase is selectively made to any angular magnitude within a predetermined range.

4. A method according to claim 1, wherein the varying of the angular phase is selectively made to advance and retard the valve opening timing.

5. A method according to claim 1, wherein the releasing of the force is selectively made at any point during opening of the intake or exhaust valve.

6. A method according to claim 1, wherein final closing movement of the intake or exhaust valve is dampened without regard for the release of the force applied by the cam.

7. An apparatus for controlling valve operation in an internal combustion engine having a crankshaft for driving a camshaft with a cam for opening and closing an intake or exhaust valve which is spring-biased in a closing direction, said apparatus comprising, phase control means disposed between the crankshaft and the camshaft and lift control means disposed between the cam and the intake or exhaust valve, said phase control means including hydraulic means for changing the angular relationship between the camshaft and a timing wheel driven by the crankshaft for driving the camshaft, means for controlling said hydraulic means in response to engine operating conditions, said lift control means including hydraulic piston means for transmitting a valve-opening force from the cam to the valve, and hydraulic valve means for selectively releasing the valve-opening force in response to engine operating conditions.

8. An apparatus according to claim 7, wherein said phase control means includes a coupling mechanism with axially movable components for changing the angular relationship, and said hydraulic means are selectively operable for causing said axial movement.

9. An apparatus according to claim 7, wherein said hydraulic piston means includes a working oil chamber filled with pressurized working oil for transmitting said valve-opening force, and said hydraulic valve means is selectively operable for releasing the working oil from said working oil chamber.

10. An apparatus according to claim 7, wherein said phase control means includes a rotatable shaft coupled to the camshaft, a timing wheel drivable by the crankshaft and disposed coaxially with the rotatable shaft for angular movement relative thereto, a piston means having one axial end facing into a hydraulic pressure chamber and normally spring-biased in one axial direction, a coupling mechanism for operatively coupling said piston means, said timing wheel, and said rotatable shaft to vary the angular phase of said timing wheel and said rotatable shaft dependent on axial movement of said piston means, and a servovalve for selectively causing communication between the hydraulic pressure chamber and either a hydraulic pressure supply passage or a hydraulic pressure release passage for controlling the axial movement of said piston means.

11. An apparatus according to claim 7, wherein said phase control means comprises a rotatable shaft coupled to the camshaft, a timing wheel drivable by the crankshaft and disposed coaxially with the rotatable shaft for angular movement relative thereto, a piston having one axial end facing into a hydraulic pressure chamber and normally spring-biased in one axial direction, said piston being coaxial with said rotatable shaft and said timing wheel, a coupling mechanism for operatively coupling said piston, said timing wheel, and said rotatable shaft to vary the angular phase of said timing wheel and said rotatable shaft dependent on axial movement of said piston, and servovalve for cutting off the communication between the hydraulic pressure chamber and a hydraulic pressure supply passage or a hydraulic pressure release passage, which communication has been achieved by operation of an actuating member, in response to axial movement of said piston according to an amount of operation of the actuating member.

12. An apparatus according to claim 7, wherein said lift control means includes, a cam piston having one end operatively coupled to said cam, a working oil chamber in which the other end of said cam piston is disposed and which is held in communication with a hydraulic pressure source, a valve piston operatively coupled to the intake or exhaust valve for opening the intake or exhaust valve under hydraulic pressure from said working oil chamber and a hydraulic pressure release valve connected to said working oil chamber for releasing the hydraulic pressure from said working oil chamber while the intake or exhaust valve is being opened.

13. An apparatus for controlling valve operation in an internal combustion engine having a crankshaft for driving a camshaft with a cam for opening and closing an intake or exhaust valve which is spring-biased in a closing direction, said apparatus comprising, phase control means disposed between the crankshaft and the camshaft and lift control means disposed between the cam and the intake or exhaust valve, said phase control means comprising a rotatable shaft coupled to the camshaft, a timing wheel drivable by the crankshaft and disposed coaxially with the rotatable shaft for angular movement relative thereto, a piston having one axial end facing into a hydraulic pressure chamber and normally spring-biased in one axial direction, said piston being coaxial with said rotatable shaft and said timing wheel, a coupling mechanism for operatively coupling said piston, said timing wheel, and said rotatable shaft to vary the angular phase of said timing wheel and said rotatable shaft dependent on axial movement of said piston, and a servovalve for cutting off the communication between the hydraulic pressure chamber and either a hydraulic pressure supply passage or a hydraulic pressure release passage in response to axial movement of said piston according to an amount of operation of an actuating member, said lift control means comprising a cam piston having one end operatively coupled to said cam, a working oil chamber in which the other end of said cam piston is disposed and which is held in communication with a hydraulic pressure source, a valve piston operatively coupled to the intake or exhaust valve for opening the intake or exhaust valve under hydraulic pressure from said working oil chamber, and a hydraulic pressure release valve connected to said working oil chamber for relieving the hydraulic pressure from said working oil chamber while the intake or exhaust valve is being opened.

* * * * *